US006929155B1

(12) United States Patent
Sayers

(10) Patent No.: US 6,929,155 B1
(45) Date of Patent: Aug. 16, 2005

(54) DISPENSER ADAPTER

(75) Inventor: Richard C. Sayers, Akron, OH (US)

(73) Assignee: Joseph S. Kanfer, Richfield, OH (US)

( * ) Notice: Subject to any disclaimer, the term of this patent is extended or adjusted under 35 U.S.C. 154(b) by 74 days.

(21) Appl. No.: 10/364,032

(22) Filed: Feb. 11, 2003

(51) Int. Cl.[7] ..... B67D 5/06
(52) U.S. Cl. ..... 222/181.3; 222/182; 222/207; 222/325
(58) Field of Search ..... 222/180, 181.1, 222/181.2, 181.3, 182, 207, 209, 325

(56) References Cited

U.S. PATENT DOCUMENTS 5,265,772 A 11/1993 Bartasevich et al. ..... 222/214
5,810,204 A * 9/1998 Devlin et al. ..... 222/82
6,216,916 B1 4/2001 Maddox et al. ..... 222/105

* cited by examiner

*Primary Examiner*—Michael Mar
*Assistant Examiner*—Patrick Buechner
(74) *Attorney, Agent, or Firm*—Renner, Kenner, Greive, Bobak, Taylor & Weber

(57) ABSTRACT

An adaptor assembly is selectively received in a dispenser so that the dispenser may selectively receive first and second types of cartridge and pump assemblies. The dispenser is configured to receive a cartridge and pump of a first type, and the adapter assembly, when selectively received in the dispenser, adapts the interior of the dispenser to receive a cartridge and pump of a second type.

11 Claims, 9 Drawing Sheets

DISPENSER ADAPTER

RELATED PATENT APPLICATIONS

None.

FIELD OF THE INVENTION

This invention generally relates to wall-mounted dispensers used to dispense soap, lotion, or other similar products onto the hand of a user. More particularly, the present invention relates to an adapter that may be applied to a wall-mounted dispenser to allow use of multiple types of refill containers and pumps within the dispenser.

BACKGROUND OF THE INVENTION

Wall-mounted dispensers are commonly used to dispense soap, lotion, and similar flowable products. In general, they consist of a wall-mounted cabinet or dispenser that defines a chamber or cavity for receipt of cartridges that contain the soap or other product. For purposes of simplicity, "soap" will be used to describe the product being dispensed. It being understood that other lotions, skin care products, or other viscous fluids can be dispensed in this fashion and that the present invention is not limited to an apparatus for dispensing skin care products per se inasmuch as other flowable products may be dispensed in accordance with the present invention.

Some prior art dispensers, as mentioned above, include a dispenser or cabinet having a base mountable on a wall or counter top and a cover attached to the base, usually by some form of hinge that allows access to the interior of the dispenser. The base includes various types of receptacles or shelves designed to support and position a cartridge, bag or box, which itself contains the soap and which is replaceable, so that the dispenser can be refilled when the supply is exhausted. For sake of simplicity, refill cartons, boxes, bags and other receptacles will be collectively referred to by the term "cartridge." These cartridges have various shapes and forms in the prior art. Perhaps the most common currently used are the so-called "bag-in-box" arrangements which include a collapsible bag filled with soap and a box for the storage and transportation of the bag. The box may be provided with a tear away portion that is removed to expose the bag therein.

As shown, for example, in prior art FIG. 8, in a "tube-type" dispenser 1, soap is dispensed from the cartridge 2 held at a height $H_T$ through an elongate tube 3 that extends downwardly from the cartridge 2 and terminates in a nozzle 4, which, when properly positioned, projects from the bottom of the dispenser. In this way, soap may be dispensed onto the hand of the user, generally by utilization of a hand-operated lever 5 which compresses the tube pump 4. The most common lever arrangements of the prior art involve a lever which is engaged by either the heel of the hand to depress and activate the pump or tube to dispense the fluid onto the palm and fingers of the hand or by the fingers of the hand to pull the lever toward the user to similarly depress and activate the pump and dispense the soap. All of these arrangements involve some sort of nozzle and pump assembly which generally includes various types of valving to control the flow of the soap by opening a tube to the reservoir or cartridge to fill it and then closing off the reservoir or cartridge and opening a valve to the nozzle to permit the soap to actually be dispensed. It is desirable in most instances to dispense a measured quantity or "charge" of soap with each actuation of the handle and, therefore, the tube or pump is generally elongate so that it accommodates a selected amount of soap. One example of such a dispenser is found in U.S. Pat. No. 5,265,772 incorporated herein by reference to the extent necessary to give meaning to the present invention.

Recognizing that the elongate tube or pump used in the tube-type dispenser requires the refill bag or cartridge to be supported a significant distance above the dispensing point, in effect, reducing the volume of soap that can be stored within the dispenser, recent design efforts have been made to eliminate the tube pump to allow the soap bag to substantially fill the interior of the dispenser. One example of such an improvement is a "dome-type" pump. One example of such a dome-type pump is shown in U.S. Pat. No. 6,216,916 B1 which is incorporated herein by reference to the extent necessary to give meaning to the present invention. As shown in prior art FIG. 9, a dome-type pump 6 generally includes a base 7 that defines a chamber that is covered by a flexible membrane 8 in the form of a dome or other similar shape. The chamber includes a first valve that is adapted to draw fluid from the soap bag into the chamber and a second valve that opens externally of the dispenser that allows soap to be dispensed from the chamber to the user's hand. As will be understood, when the dome is depressed, a check valve within the first valve prevents backflow of the soap into the bag and causes the soap to be dispensed through the second valve. When the dome is released and allowed to expand, the suction created thereby draws soap from the cartridge into the chamber. In this way, a metered charge of soap is stored in the chamber. As best shown in prior art FIG. 9, the dome-type pump 6 is located closer to the bottom of the dispenser, relative to a tube-type pump (FIG. 8), freeing up additional space within the dispenser for the storage of the soap. As shown in FIG. 9, the cartridge is supported at a shorter height HD relative to the nozzle 9 of dome pump 6. In this way, a larger cartridge having greater volume of soap may be stored within the dispenser.

While the dome-type dispenser has the advantage of reducing the number of times that the dispenser needs to be filled, one disadvantage that has arisen with the use of such dispensers is the need to carry different sized cartridges, when different types of pumps are used at a given location. For example, a building may have a mixture of tube and dome-type dispensers requiring orders of two separate refill cartridges in smaller quantities than if only a single type of cartridge needed to be ordered. As can be expected, this may impact the cost of purchasing such cartridges. Consequently, it is desirable to have an adapter that allows a user to use a tube-type refill bag in connection with a dome-type dispenser.

SUMMARY OF THE INVENTION

It is, therefore, an object of the present invention to provide a dispenser adapter that allows the use of a tube-type refill bag in connection with a dome-type dispenser.

In light of the foregoing object, the present invention generally provides an adapter assembly used in conjunction with a dispenser having a base mountable on a supporting surface and a cover removably attached to the base so that it can be opened for replacement of a cartridge received within a cavity defined within the dispenser, and a handle assembly for causing fluid to be dispensed from the cartridge at a dispensing point, wherein the cavity of the dispenser is sized to receive a cartridge and a pump of a first type and the adapter is used in conjunction with the dispenser to allow use of a cartridge and pump of a second type within the dispenser, the adapter assembly including, a support received in the cavity of the dispenser having a seat located at a selected height corresponding to the cartridge of the second type, wherein the seat supportingly engages the cartridge of the second type, a guide assembly located within the dispenser contacting the pump to position the pump relative to the handle assembly, such that the handle assembly selectively contacts the pump to cause dispensing of fluid therefrom, and a nozzle locating assembly supported on the dispenser near the dispensing point having a receiver adapted to position the nozzle of the pump of the second type at the dispensing point.

The present invention further provides a dispenser adapter used in conjunction with a dispenser having a cavity for receiving a cartridge of a first type and a handle assembly adapted to dispense fluid from the cartridge, the dispenser adapter being adapted to allow use of a cartridge and pump of a second type within the dispenser, the dispenser adapter including a support received in the cavity and carried by the dispenser at a selected height, a guide surface extending forward from the support adapted to urge a nozzle of the pump toward a dispensing point, a nozzle securing assembly having a receiver in which a portion of the pump is received to position the nozzle relative to the dispensing point, and a handle extension assembly supported on the dispenser and located between the handle assembly and the pump, whereby the handle extension assembly selectively engages the handle assembly to operate the pump.

The present invention further provides a dispenser adapter allowing use of a cartridge and pump of a second type in conjunction with a dispenser adapted to receive a cartridge and pump of a first type, the dispenser including a handle assembly operative with the pump to release soap at a dispensing point, the dispenser adapter including a support carried by the dispenser, the support being located at a selected height to hold the cartridge of the second type at the selected height, a nozzle locating assembly supported on the dispenser and vertically spaced from the support, a receiver formed on the nozzle locating assembly, wherein a portion of the pump of the second type is grasped by the receiver, the receiver being aligned with the dispensing point and adapted to align the nozzle of the pump of the second type therewith, a guide carried on the nozzle locating dissembly extending toward the handle assembly, wherein at least a portion of the pump is located between the guide and the handle assembly, whereby the pump is compressed between the handles assembly and the guide upon actuation of the handle assembly.

BRIEF DESCRIPTION OF THE PREFERRED EMBODIMENTS

FIGS. 1 through 7 of the drawings show a dispenser in which an adapter of the present invention would be used. It should be noted that the dispenser, which is generally indicated by the numeral 10, is intended to be exemplary only and the adapter could be implemented within dispensers of other designs.

Figure 1:
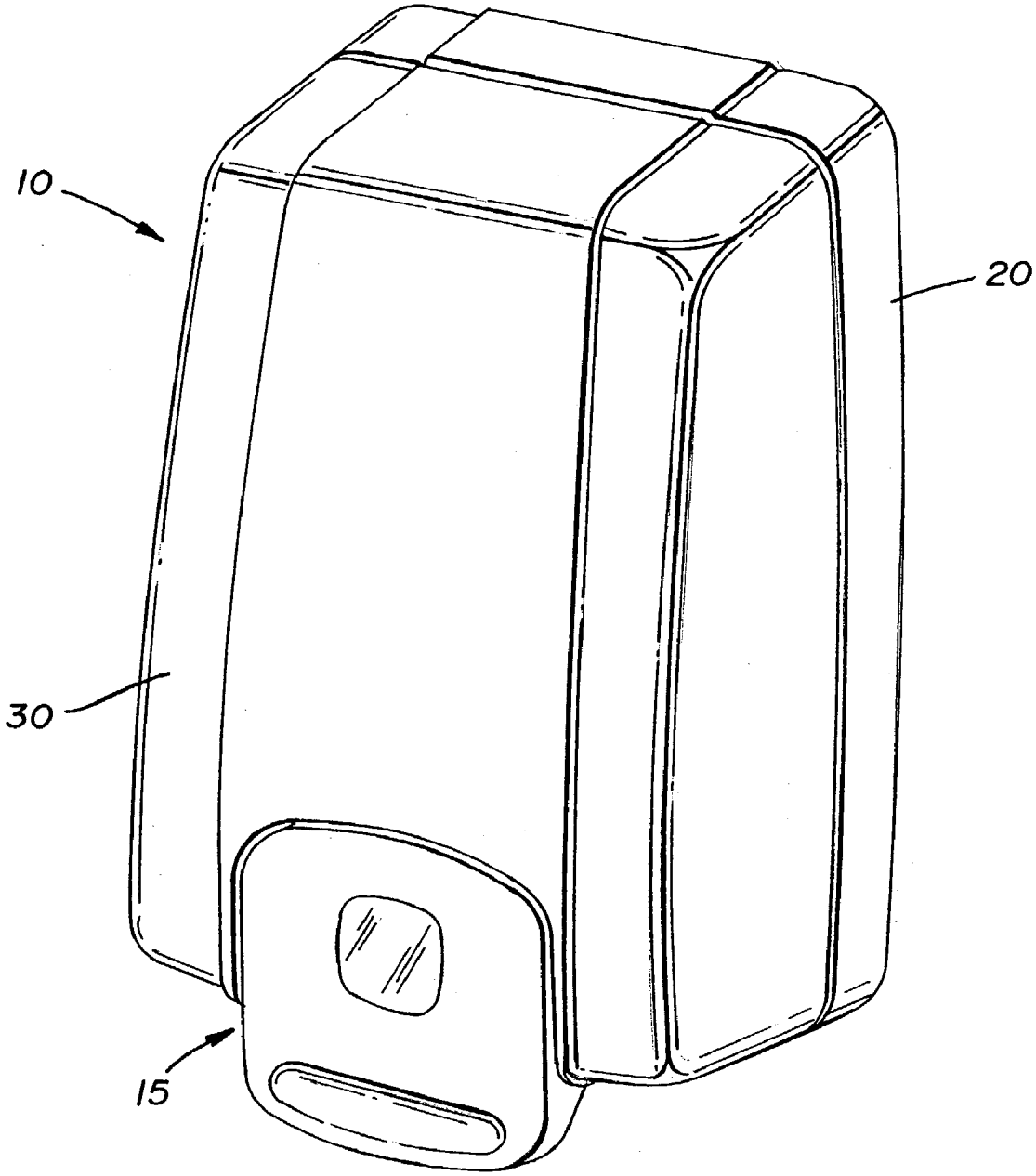
FIG. 1 is a perspective view of a dispenser according to the concepts of the present invention.

With reference to FIG. 1, the dispenser 10 generally includes a base 20 that is intended to be mounted on a wall or other supporting surface, and a cover 30 that is hingedly attached to the base 20 so that it can be opened for replacement of a cartridge 40 (FIG. 2), which is illustrated as a collapsible bag, containing soap which is received within a cavity C defined by the dispenser 10.

Figure 9:
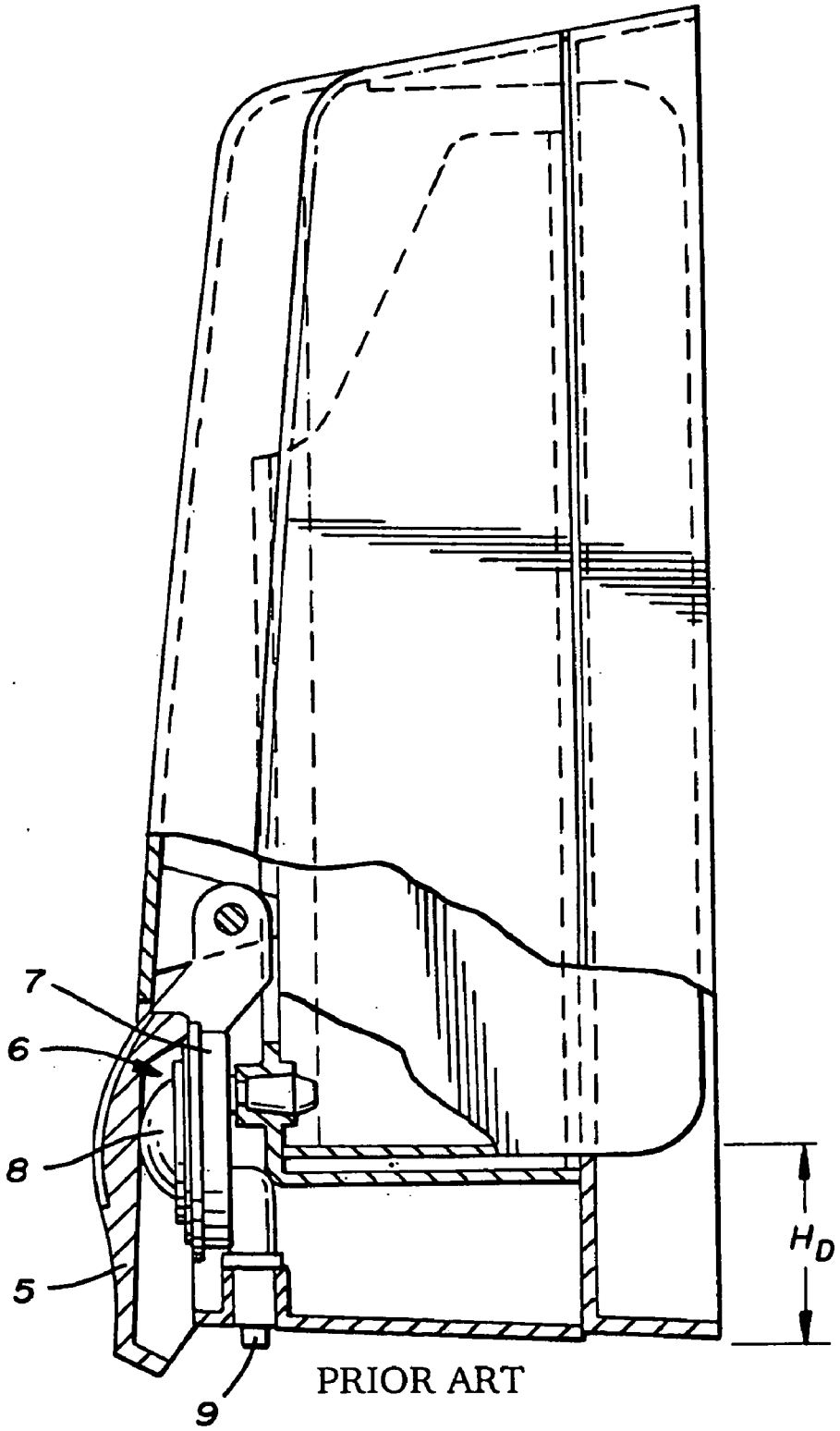
FIG. 9 is a prior art Figure depicting one example of a dome-type dispenser in section.

The cavity C of dispenser 10 is sized to receive a cartridge 40 of a first type. For example, in the embodiment depicted in the Figures, cavity C is sized to receive a cartridge 40 used in connection with a dome pump (FIG. 9). A handle assembly, generally indicated by the numeral 15, is pivotally supported on cover 30 and is used to dispense soap.

Figure 3:
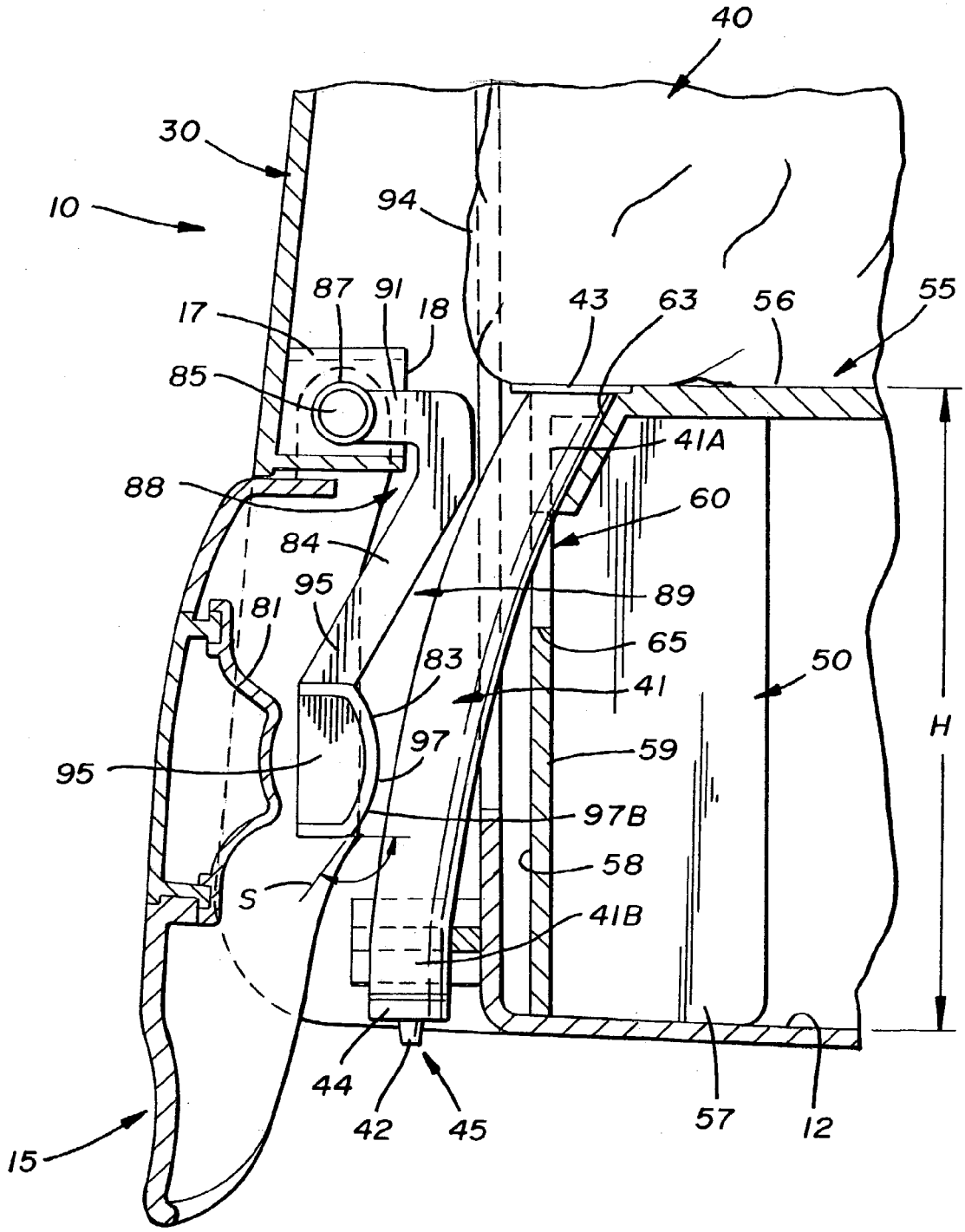
FIG. 3 is an enlarged fragmental sectional side elevational view depicting the adapter depicted in FIG. 2 in greater detail.
Figure 8:
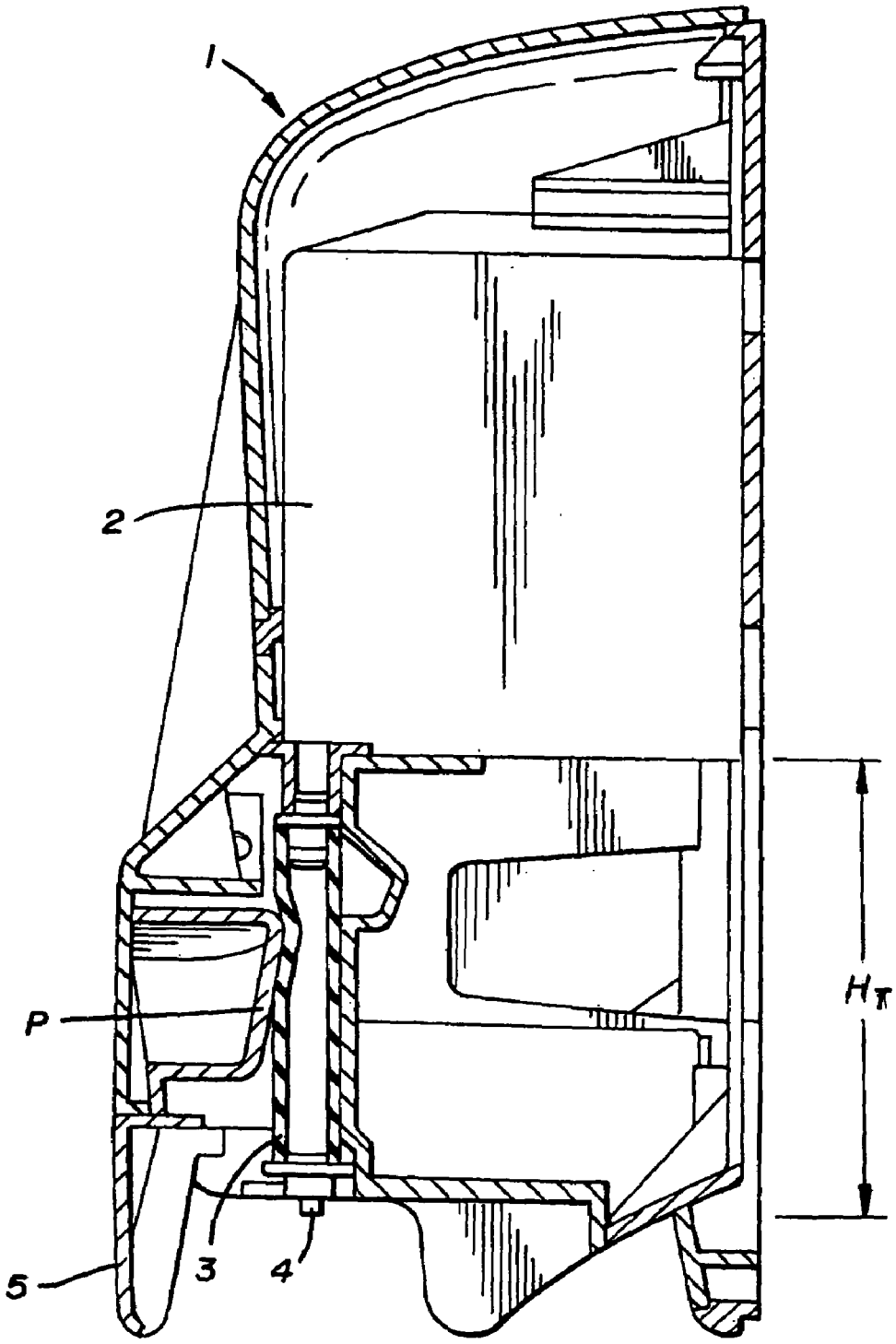
PRIOR ART FIG. 8
FIG. 8 is a prior art Figure depicting one example of a tube-type dispenser.

An adapter assembly, generally indicated by the numeral 50, includes a support, generally indicated by the numeral 55, that may be inserted within cavity C of dispenser 10 to allow use of a cartridge 40 of a second type, for example, the cartridge 40 is used with a tube-type pump (FIG. 8). As best shown in FIG. 3, support 55 may be used to elevate the cartridge 40 to a suitable height H, such that, the pump 41, when in the example shown, is a tube that extends from the central portion 42 of cartridge 40 is fully extended and has a nozzle 42 located at the dispensing point, generally indicated by the numeral 45, where soap may be delivered onto the user's hand, as previously described. In the example shown, since a tube-type cartridge 40 is being used, the desired height H may be substantially equal to the height HT of the tube-type cartridge 40, shown in FIG. 8. It will be appreciated that the desired height will vary depending on the type of cartridge 40 being used and suitable adjustment of ht support 55 may be made.

Support 55 has a seat 56 upon which the cartridge 40 rests. It will be appreciated that the seat 56 may take on a variety of forms and may include one or more members designed to supportingly engage the cartridge 40 to maintain cartridge 40 at the desired height H. To hold the cartridge 40 at the desired height H, the seat 56 may be attached to or supported on the dispenser 10, as by a bracket, fastener, or other support means. For example, in the embodiment depicted in FIG. 2, seat 56 is supported on a downwardly extending column 57 that contacts the lower wall 12 of cavity C (FIG. 3) in the dispenser 10. The seat 56 may further be provided with a forward facing surface 58 against which the pump 41 may be compressed to discharge soap from the nozzle 42. In the embodiment depicted in FIG. 2, forward facing surface 58 is formed on a member 59 that extends downward from the leading edge of seat 56.

As best shown in prior art FIGS. 8 and 9, the handle assemblies 15 of the dome and tube-type dispensers may be different based on the different pump types. Notably, in the dome-type dispenser, shown in FIG. 9, the dome 8 of the pump 6 extends forward toward the handle assembly such that the handle 5 readily contacts the dome 8 without the need for an elongated rearwardly extending projection P, shown in the tube-type pump T, depicted in FIG. 8. Further, due to the location of the dome pump 6, the dispensing point of the dome-type pump is located forward of the dispensing point of the tube-type pump. Consequently, to properly position the pump 41, it may be necessary to deflect the pump 41 forward from the cartridge 40 to ensure that the nozzle 42 is properly located relative to the dispensing point 45. To that end, a guide assembly, generally indicated by the numeral 60 is provided.

Figure 2:
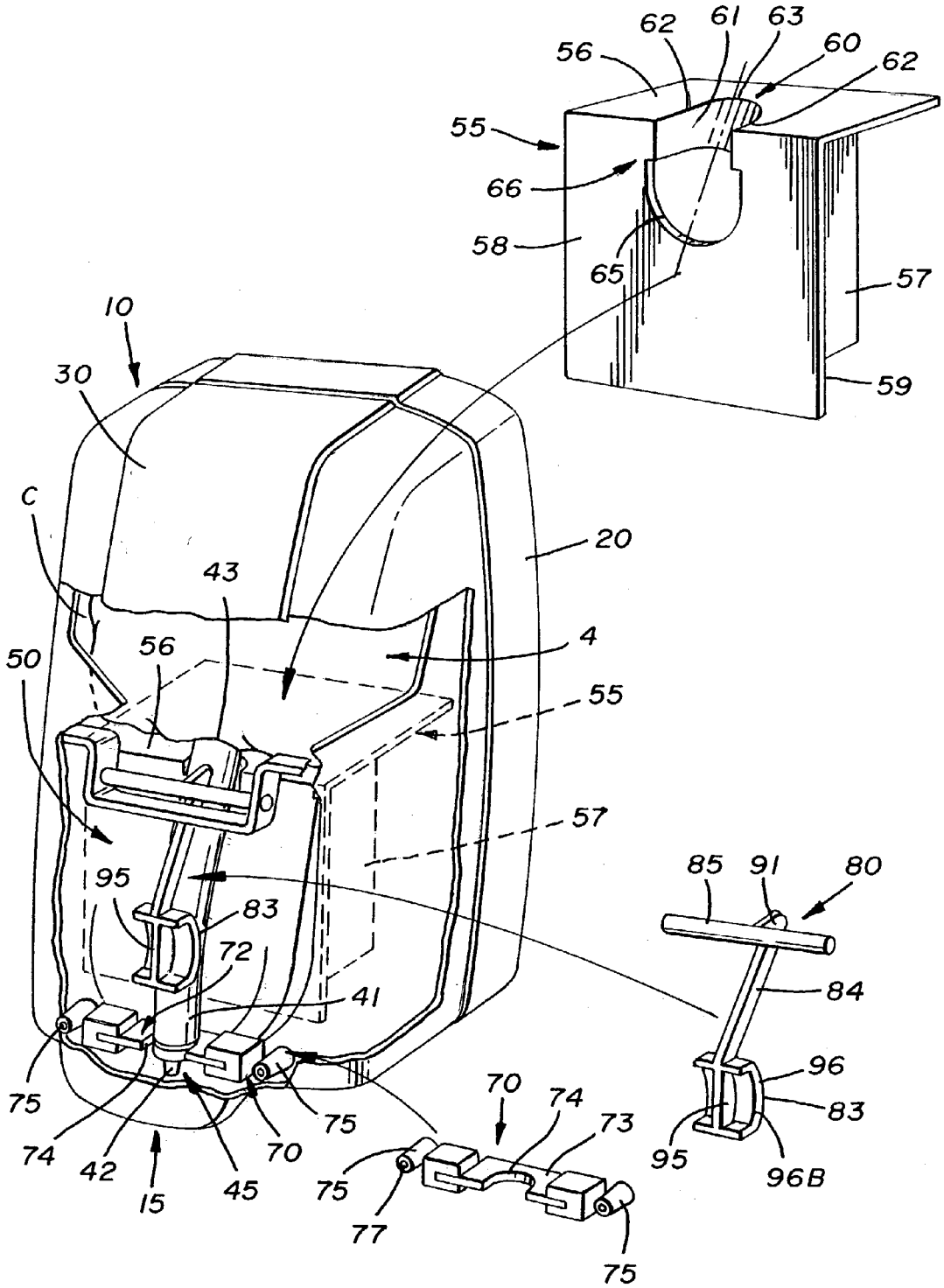
FIG. 2 is a perspective view similar to FIG. 1 with a portion of the cover cut away to show details of the interior of the dispenser, where portions of an adapter according to the concepts of the present invention have been shown externally of the dispenser to depict them in greater detail.

In the embodiment depicted in FIGS. 2 and 3, guide assembly 60 includes a recess formed in the seat 56 and member 59. Recess 61 extends rearwardly from the vertical plane of surface 58 into the seat 56, and downwardly from the horizontal plane of the seat 56 into surface 58. As shown, for example, in FIG. 2, the recess 61 may be generally U-shaped having generally planar side walls 62 and an arcuate connecting portion 63. To help locate the pump 41, and secure the pump 41 within the recess 61, a flange may extend radially inwardly from the sidewalls 62 and/or connecting portion 63 into recess 61. The flange may be located above the base 65 of the recess 61 to provide a slight clearance beneath the flange 64, such that, upon insertion of the pump 41 within recess 61, a portion of the pump 41 is allowed to expand radially outward beneath the flange 64 to axially hold the pump 41 within the recess 61. In this way, an upper portion 41A of pump 41 is properly located by the guide 60. As best shown in FIG. 3, to further position the pump 41, a portion of the recess 61 may extend forwardly to urge the pump 41 toward handle assembly 15. For example, the rear portion of recess 61, generally corresponding to connecting portion 63, may extend forward, toward handle assembly 15, at an incline. The guide 60 further locates the pump 41 in the lateral sense relative to handle assembly 15 to ensure consistent compression of the pump 41 by handle 15, as will be described more completely below.

Figure 5:
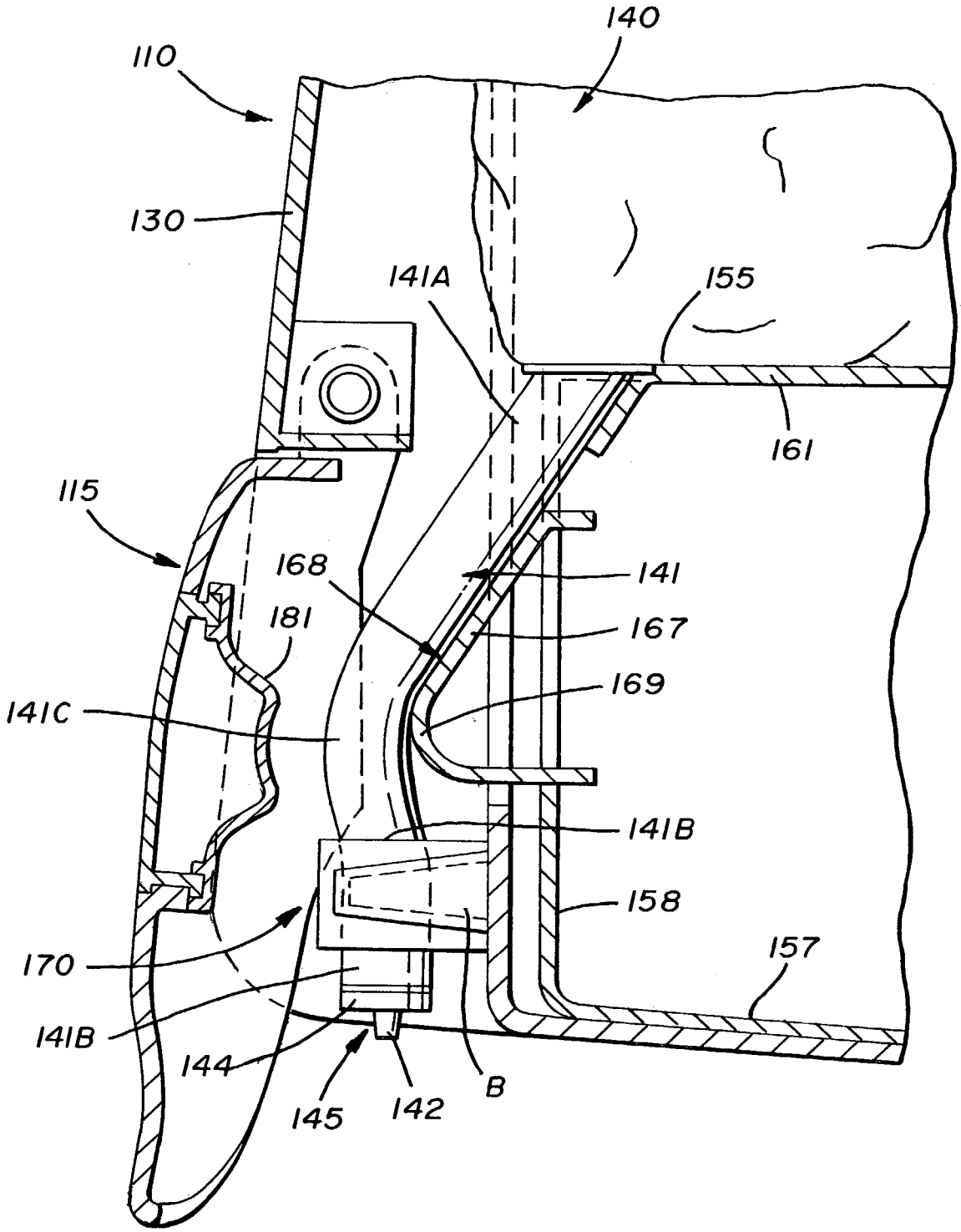
FIG. 5 is an enlarged fragmental sectional side elevational view depicting the first alternative adapter embodiment in greater detail.

Adapter assembly 50, may include a nozzle locating assembly 70 that attaches to the dispenser 10 near the dispersion point 45. Nozzle locating assembly 70 generally includes a receiver, generally indicated by the numeral 72 adapted to properly locate the pump 41 relative to handle assembly 15 and dispersion point 45. With that in mind, nozzle locating assembly 70 may be adapted to grasp the nozzle 42 and secure it, such that, the nozzle 42 does not move to a great extent during compression of the pump 41. Nozzle 42 often may be provided with a radially extending flange 44 that is conveniently grasped by nozzle locating assembly 70 for this purpose. In the example depicted in FIG. 2, the receiver 72 includes a plate 73 defining a recess 74 sized to receive the lower extremity 41B of pump 41 at or slightly above the nozzle 42. The recess 74 may be sized slightly smaller than the pump 41 as to create an interference fit therewith. Further, the recess 74 may be sized smaller than the flange 44 so as to provide a positive stop to axial movement of the nozzle 42 in the upward direction. Nozzle locating assembly 70 may be attached in any known manner to the dispenser 10. Conveniently, cap assemblies, generally indicated at 75, may be provided to attach the nozzle locating assembly 70 to protruding surfaces within the dispenser 10, such as bosses B (FIG. 5). In the embodiment shown, cap assemblies 75 generally are in the form of cup-like members having an internal cavity sized to fit over a protruding surface within the dispenser 10. Cap assemblies may be sized to provide an interference fit, such that the nozzle locating assembly 70 may be snapped or pressed into place on the dispenser 10. If desired, as shown in the embodiment depicted in FIG. 2, cap assembly 75 may be further secured, as by adhesives or a fastener driven into the underlying boss B through receivers 77.

In some instances it may be desirable to provide additional leverage for the compression of the tube 41, and, to that end, adapter assembly 50 may include a handle extension assembly, generally indicated by the numeral 80. Handle extension assembly 80 is adapted to extend the effective length of the rearwardly extending portion 81 of the handle 15 that is used to compress the tube 41. In this way, the shorter stroke ordinarily used to operate the dome-type pump 6 is effective in completely compressing the tube 41. Extension assembly 80 includes a ram 83 vertically aligned with handle 15, and, as necessary, a protruding portion 81 of the handle 15 as by a hanger 84 that is pivotally supported on a cross bar 85 that fits within openings or cylindrical bearings, generally referred to as receivers 87, defined within the handle mounting bracket 17. It will be appreciated that to maintain suitable clearance, generally indicated by the numeral 88, between the assembly 80 and the handle supporting structure 17, that hanger 84 may be provided with a convoluted shape to wend its way around the various structures within the dispenser 10. Furthermore, suitable clearance 89 between the tube 41 and the hanger 84 must be maintained to ensure that the tube 41 is not inadvertently compressed or damaged. In the example shown in FIG. 3, hanger 84 includes a top portion 91 that extends rearwardly of the pin 85 beyond a plane extending through the inward end 18 of bracket 17. A first intermediate portion 93 of hanger 84 extends downwardly from the top portion 91 and has a rearward extremity that extends just short of the plane defined by the front face 94 of the cartridge 40. To provide clearance 89 for the tube 41, the lower portion 95 of hanger 84 extends downwardly and forwardly toward the rearwardly extending portion 81 of handle 15, where it connects with the ram 83. Since the extension assembly 80 is pivotally supported within the dispenser 10, it may be pivoted into contact with the tube 41 under force of the handle 15.

To avoid damage to the tube 41, the ram 83 may be provided with a wide face 97 such that stress is not concentrated at a point on the ram 83. For example, face 97 may have a width substantially equal to the diameter of tube 41 or greater. Further, the face 97 may be made arcuate. The forward slope S of the lower portion 97B of face 97 may further help direct fluid within the tube 41 downward toward the dispensing point 45.

In operation, the rearwardly extending portion 81 of handle 15 would contact a portion of the ram 83, such as a rib 96 to urge the ram 83 into contact with the tube 41. In this way, the ram 83 compresses the tube 41 between itself and the forward facing surface 58.

Figure 4:
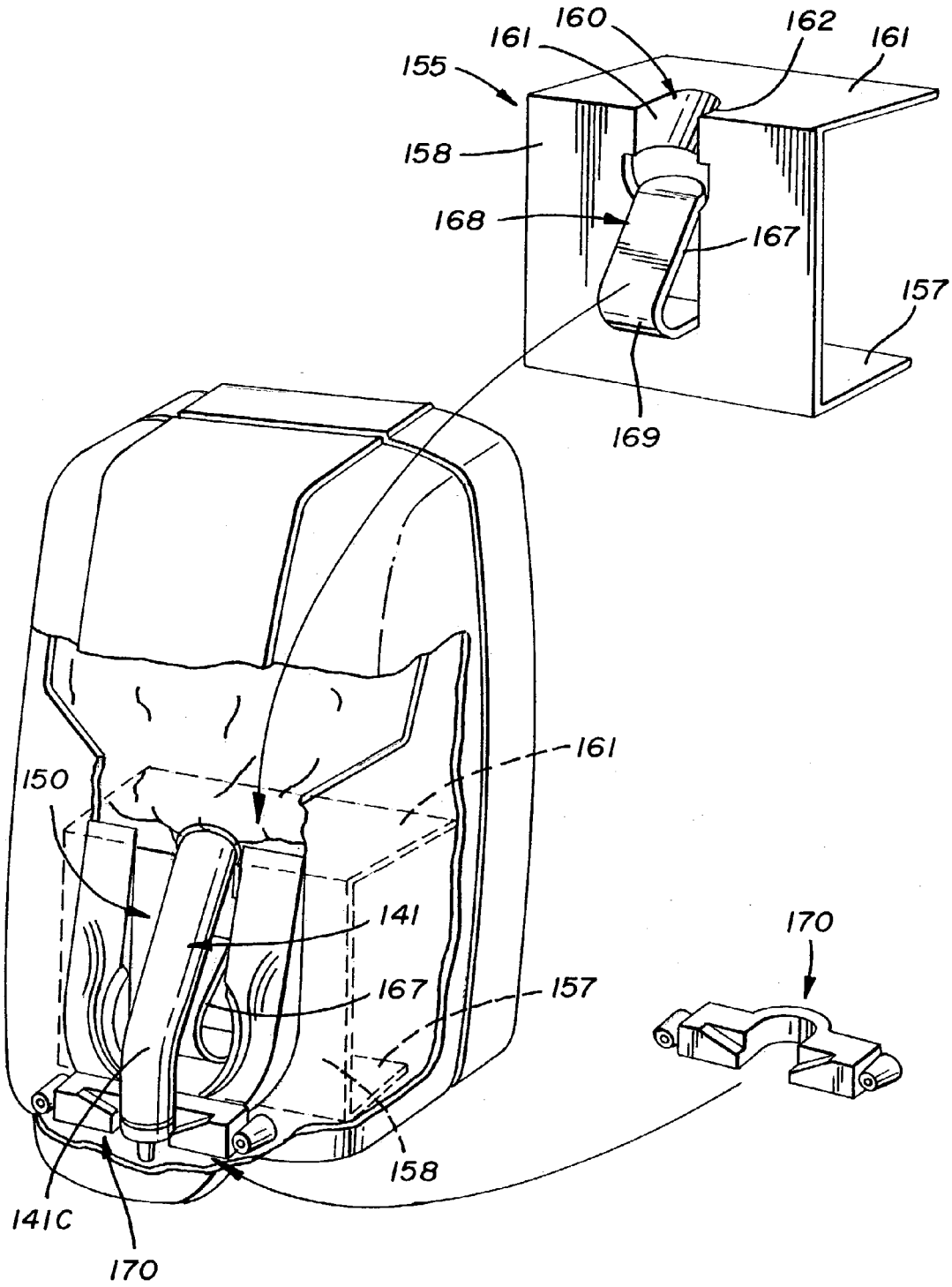
FIG. 4 is a perspective view of a dispenser similar to that shown in FIG. 1, partially cut-away to depict details of a first alternative embodiment of an adapter according to the concepts of the present invention, where portions of the adapter have been shown externally of the dispenser to depict them in greater detail.

A first alternative adapter assembly, generally indicated by the numeral 150 is shown in FIGS. 4 and 5. Since first alternative adapter assembly 150 shares some of the same components as first adapter assembly 50, like numerals will be used to refer to like parts.

An alternative support 155 is shown in FIG. 5, where it excludes the upstanding column 57 and replaces it with a base portion 157, such that the support 155 is generally a U-shaped member having rearwardly extending seat 156 and base 157 joined by a cross member 158. Alternative support 155 is another example of a means of supporting cartridge 40, it being understood that any other support may be substituted for support 155 in the given embodiment.

In the first alternative adapter assembly 150, the guide, generally indicated by the numeral 160, is carried on support 155 and includes a projection, generally indicated by the numeral 168, that extends forwardly of the plane of the forward facing surface 158 effectively extending the surface 158 forward, such that a portion 141C of tube 141 is placed in closer proximity to the handle 115. It will be appreciated that the projection 168 may generally be of any form suitable for displacing the tube 141 toward the handle 115. In the example shown, projection 168 includes a downwardly and forwardly sloping ramp portion 167 that provides gradual displacement of the tube 141 from its upper portion 141A to the central portion 141C. In this way, any crimping of the tube 141 is avoided along with any potential choking of the soap within the tube 141. A nose portion 169 of the projection 168 is curved downwardly and inwardly allowing the lower portion 141B of the tube 141 and facilitate its return to the dispensing point 145. As in the previous embodiment, a nozzle locating assembly 170 may be provided to secure the nozzle 142 of tube 141 at the dispensing point 145.

In operation, the alternative guide assembly 160, which has projection 168 shortens the distance between the tube 141 and handle 115, facilitating compression of the tube 141 with a shorter stroke of handle 115.

Figure 6:
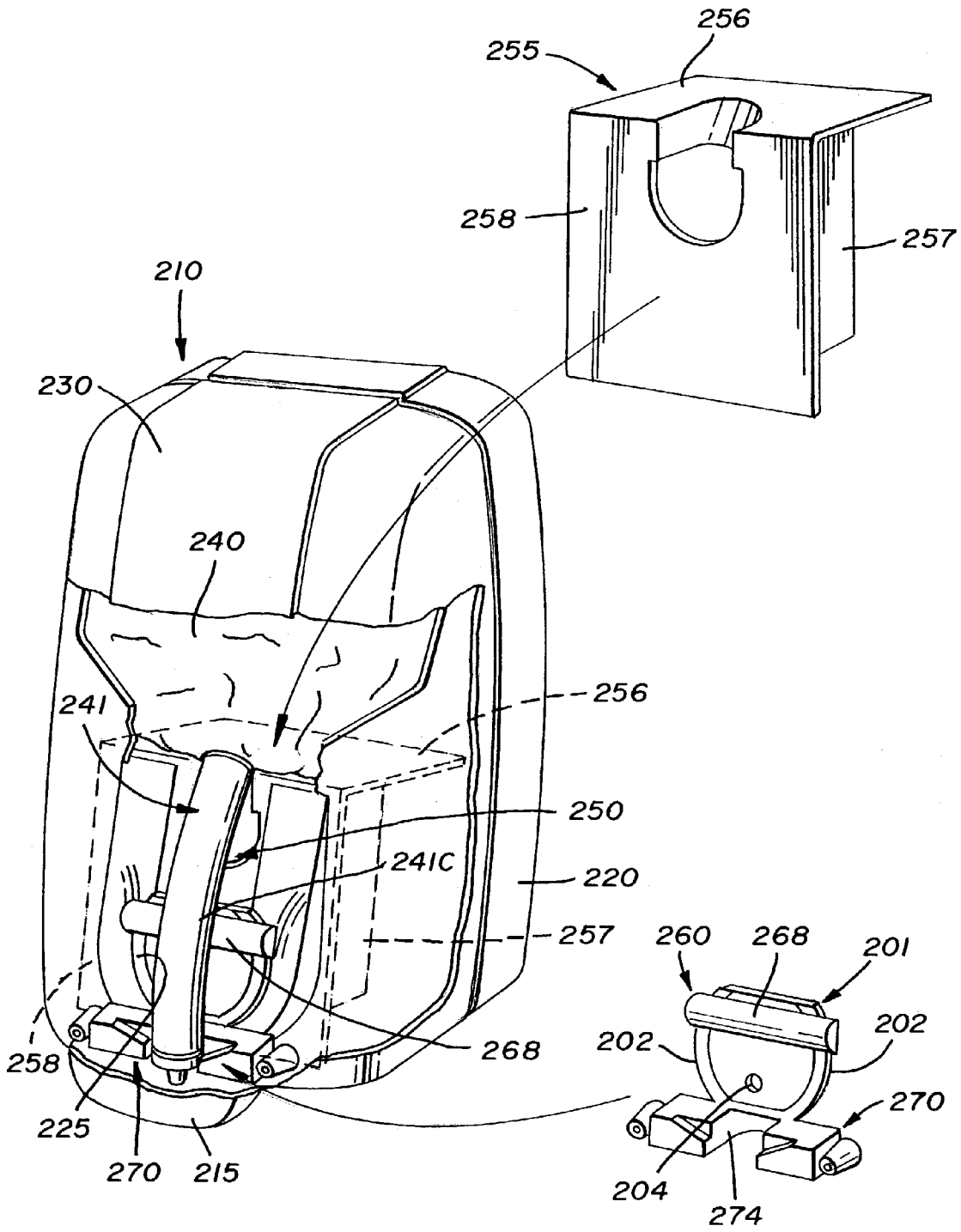
FIG. 6 is a perspective view of a dispenser similar to that shown in FIG. 1, partially cut-away to depict details of a second alternative embodiment of an adapter according to the concepts of the present invention, where portions of the adapter have been shown externally of the dispenser to depict them in greater detail.
Figure 7:
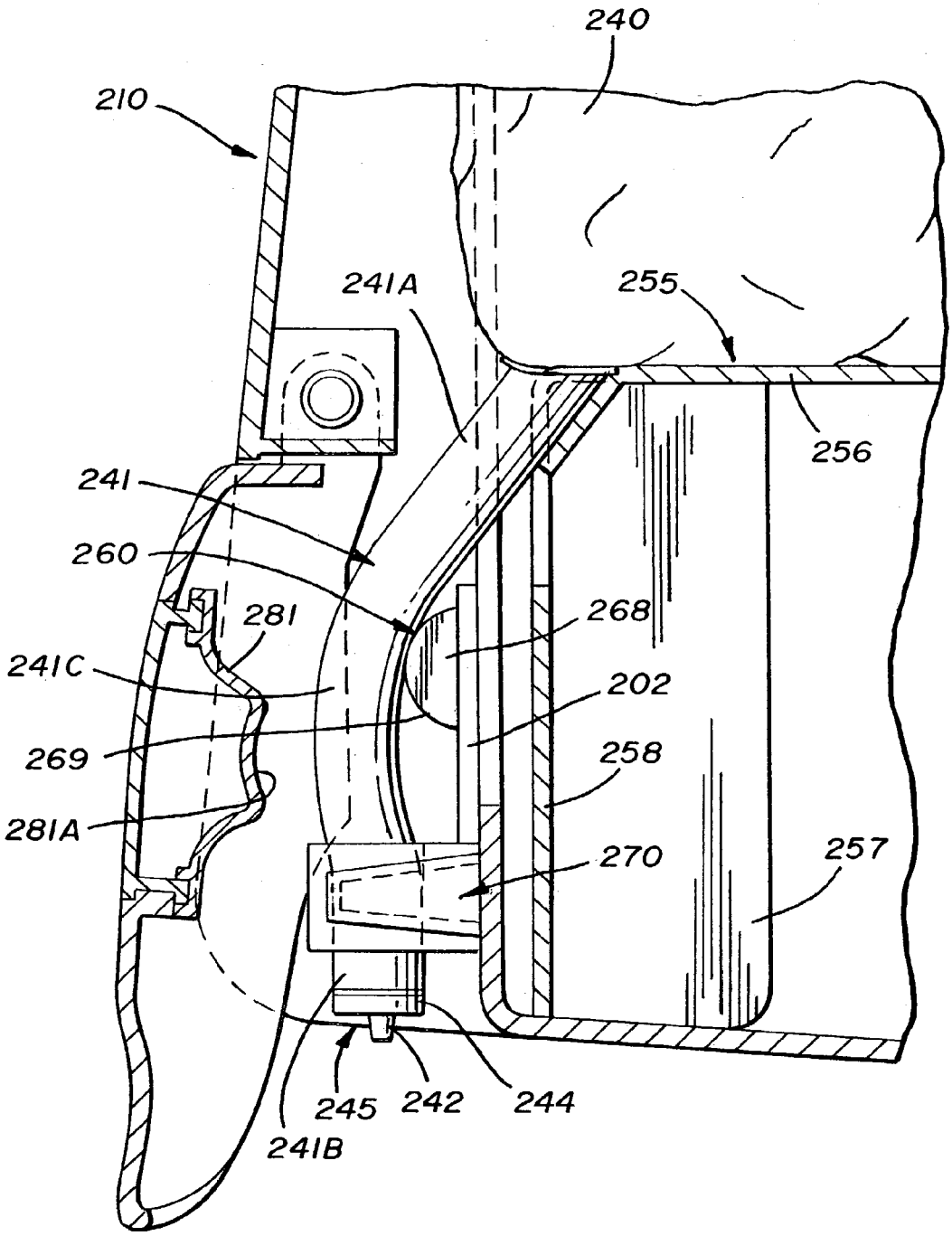
FIG. 7 is an enlarged fragmental sectional side elevational view depicting the second alternative adapter embodiment in greater detail.

In a second alternative adapter embodiment, generally indicated by the numeral 250 and shown in FIG. 6, the projection portion 268 of guide 260 is supported on nozzle locating assembly 270. To that end, nozzle locating assembly 270 is provided with a backboard plate 201 on which an alternative guide 260 is mounted. As best shown in FIG. 6, guide 260 includes a forwardly extending projection 268 that deflects the central portion 241C of the tube 241 forward toward the handle assembly 215 to facilitate compression of the tube 241. As shown in FIG. 7, projection 268 may be provided with an arcuate outer surface 269 to reduce the likelihood of damage to the tube 241 and to mate with a curved surface 281A of the rearwardly extending portion 281 of handle 215. Thus, as the handle 215 is actuated, the tube 241 is compressed between the mating arcuate surfaces 281A and 269 of the handle 215 and projection 268, respectively.

The backboard 201 of guide 260 may be provided with sides 202 that are shaped to conform to the recess 225 in base 220 that ordinarily receives the dome-type pump D (FIG. 9). In the example shown, sides 202 are curved in a generally semi-circular fashion to fit within the circular confines of the dome pump recess 225. Sides 202 may be just slightly larger than recess 225 to form an interference fit between recess 225 and backboard 201. A receiver 204 may be formed in the backboard 201 for receipt of a fastener (not shown) to more securely attach the backboard 201 to the base 220.

Operation of all of the above embodiments is the same as an ordinary dispenser. By providing the guide assemblies 60, 160, 260, the stroke ordinarily used to dispense material from a dome-type pump will suitably compress the tube 41, 141, 241 of the adapted pump to dispense a desired charge of soap. When the user releases the handle 15, 115, 215, the tube 41, 141, 241 expands drawing an additional charge of soap from the cartridge 40, 140, 240 into the tube 41, 141, 241.

Assembly of each of the above embodiments also occurs in similar fashion. The support 50, 150, 250 is placed within the cavity C and may be attached if necessary. The nozzle locating assembly 70, 170, 270 is attached to the dispenser 10, 110, 210, and the cartridge may then be placed on the seat 56, 156, 256 of support 55, 155, 255. With the cartridge 40, 140, 240 in place, the tube 41, 141, 241 is extended downward over the guide assembly 60, 160, 260 and may be secured at the nozzle locating assembly 70, 170, 270. If, as explained above, additional leverage is necessary to compress the tube 41, a handle extension assembly 80 may be installed to effectively extend the handle 15 rearward for compression of the tube 41. As depicted in FIGS. 1–3, this extension assembly may be pivotally supported on the handle support bracket 17. While this pivoting support may be achieved in any known manner, some existing dispenser designs have suitable receivers or bearings that can be used to rotatably support a cross bar 85. Thus, assembly would include inserting the ends of the cross bar 85 into receivers 87 located on the handle support bracket 17.

It will now be seen that a dispenser adapter according to the concepts of the present invention may be used to allow use of multiple soap cartridges within a single dispenser. It will be appreciated that various modifications and substitutions may be made within the spirit of the foregoing description, and, thus, for a true appreciation of the scope of the present invention, reference should be made to the following claims.

What is claimed is:

1. An adaptor assembly used in conjunction with a dispenser having a base mountable on a supporting surface and a cover removably attached to the base so that it can be opened for replacement of a cartridge received within a cavity defined within the dispenser, and a handle assembly for causing fluid to be dispensed from the cartridge at a dispensing point, wherein the cavity of the dispenser is sized to receive a cartridge and a pump of a first type and the adapter is used in conjunction with the dispenser to allow use of a cartridge and pump of a second type within the dispenser, the adapter assembly comprising:

a support received in the cavity of the dispenser having a seat located at a selected height corresponding to the cartridge of the second type, wherein said seat supportingly engages the cartridge of the second type;

a guide assembly located within the dispenser and including a recess defined in said support and located relative to the cartridge of the second type, said recess being defined by a wall, with a connecting portion of said wall being located rearward of the pump of the second type and extending forwardly at an incline such that said recess receives a portion of the pump to position the pump relative to the handle assembly, such that the handle assembly selectively contacts the pump to cause dispensing of fluid therefrom; and a nozzle locating assembly supported on the dispenser near the dispensing point having a receiver adapted to position the nozzle of the pump of the second type at the dispensing point.

2. The adapter assembly of claim 1, wherein the guide assembly is laterally aligned with the handle assembly, such that, the guide assembly aligns the pump of the second type with the handle assembly.

3. The adapter assembly of claim 1, wherein said support includes a base portion extending substantially parallel to the seat and a cross member joining the seat to the base portion.

4. An adapter assembly used in conjunction with a dispenser having a base mountable on a supporting surface and a cover removably attached to the base so that it can be opened for replacement of a cartridge received within a cavity defined within the dispenser, and a handle assembly for causing fluid to be dispensed from the cartridge at a dispensing point, wherein the cavity of the dispenser is sized to receive a cartridge and a pump of a first type and the adapter is used in conjunction with the dispenser to allow use of a cartridge and pump of a second type within the dispenser, the adapter assembly comprising:

a support received in the cavity of the dispenser having a seat located at a selected height corresponding to the cartridge of the second type, wherein said seat supportingly engages the cartridge of the second type;

a guide assembly located within the dispenser and including a projection extending toward the handle assembly and contacting the pump to deflect it toward the handle assembly such that the handle assembly selectively contacts the pump to cause dispensing of fluid therefrom; and a nozzle locating assembly supported on the dispenser near the dispensing point having a receiver adapted to position the nozzle of the pump of the second type at the dispensing point.

5. The adapter assembly of claim 4, wherein the projection is carried on the support.

6. The adapter assembly of claim 4, wherein the projection is carried on a member extending from the nozzle locating assembly.

7. The adapter assembly of claim 4, wherein said guide assembly includes a curved surface adapted to engage the pump.

8. An adapter assembly used in conjunction with a dispenser having a base mountable on a supporting surface and a cover removably attached to the base so that it can be opened for replacement of a cartridge received within a cavity defined within the dispenser, and a handle assembly for causing fluid to be dispensed from the cartridge at a dispensing point, wherein the cavity of the dispenser is sized to receive a cartridge and a pump of a first type and the adapter is used in conjunction with the dispenser to allow use of a cartridge and pump of a second type within the dispenser, the adapter assembly comprising:

a support received in the cavity of the dispenser having a seat located at a selected height corresponding to the cartridge of the second type, wherein said seat supportingly engages the cartridge of the second type;

a guide assembly located within the dispenser contacting the pump to position the pump relative to the handle assembly, such that the handle assembly selectively contacts the pump to cause dispensing of fluid therefrom;

a nozzle locating assembly supported on the dispenser near the dispensing point having a receiver adapted to position the nozzle of the pump of the second type at the dispensing point;

a handle extension supported within said dispenser between the handle assembly and the pump of the second type, said handle extension including a ram having a curved surface facing the pump and a cross bar pivotally received within receivers defined within the dispenser;

wherein said ram is attached to said cross bar by a hanger and the handle assembly engages the ram to actuate the pump to cause dispensing of fluid therefrom.

9. The adapter assembly of claim 8, wherein said hanger extends rearwardly from the cross bar to a rearward extremity, and includes a member that extends from the rearward extremity to the ram locating the ram adjacent the handle assembly.

10. A dispenser adapter used in conjunction with a dispenser having a cavity for receiving a cartridge of a first type and a handle assembly adapted to dispense fluid from the cartridge, the dispenser adapter being adapted to allow use of a cartridge and pump of a second type within the dispenser, the dispenser adapter comprising:

a support received in said cavity and carried by the dispenser at a selected height;

a guide surface extending forward from said support adapted to urge a nozzle of the pump toward a dispensing point;

a nozzle securing assembly having a receiver in which a portion of the pump is received to position the nozzle relative to the dispensing point; and a handle extension assembly supported on the dispenser and located between the handle assembly and the pump, whereby the handle extension assembly selectively engages the handle assembly to operate the pump.

11. A dispenser adapter allowing use of a cartridge and pump of a second type in conjunction with a dispenser adapted to receive a cartridge and pump of a first type, said dispenser including a handle assembly operative with the pump to release soap at a dispensing point, the dispenser adapter comprising:

a) a support carried by the dispenser, 1) said support being located at a selected height to hold the cartridge of the second type at the selected height, b) a nozzle locating assembly supported on said dispenser and vertically spaced from said support;

1) a receiver formed on said nozzle locating assembly, wherein a portion of the pump of the second type is grasped by said receiver;

2) said receiver being aligned with the dispensing point and adapted to align the nozzle of the pump of the second type therewith;

c) a guide carried on said nozzle locating dissembly extending toward the handle assembly;

1) wherein at least a portion of said pump is located between said guide and the handle assembly, whereby said pump is compressed between the handles assembly and said guide upon actuation of the handle assembly.

* * * * *